US011136777B2

(12) United States Patent
El-Salakawy et al.

(10) Patent No.: US 11,136,777 B2
(45) Date of Patent: Oct. 5, 2021

(54) SEISMIC PERFORMANCE IMPROVEMENT OF FRP-RC STRUCTURES

(71) Applicant: University of Manitoba, Winnipeg (CA)

(72) Inventors: Ehab El-Salakawy, Winnipeg (CA); Shervin Khalili Ghomi, Winnipeg (CA)

(73) Assignee: University of Manitoba, Winnipeg (CA)

( * ) Notice: Subject to any disclaimer, the term of this patent is extended or adjusted under 35 U.S.C. 154(b) by 0 days.

(21) Appl. No.: 16/648,412

(22) PCT Filed: Sep. 13, 2018

(86) PCT No.: PCT/CA2018/051133

§ 371 (c)(1),
(2) Date: Mar. 18, 2020

(87) PCT Pub. No.: WO2019/056091

PCT Pub. Date: Mar. 28, 2019

(65) Prior Publication Data

US 2020/0263445 A1 Aug. 20, 2020

Related U.S. Application Data

(60) Provisional application No. 62/560,358, filed on Sep. 19, 2017.

(51) Int. Cl.
*E04H 9/02* (2006.01)
*E04B 1/21* (2006.01)
(Continued)

(52) U.S. Cl.
CPC ..... *E04H 9/021* (2013.01); *E04B 1/215* (2013.01); *E04B 1/2403* (2013.01); *E04B 1/98* (2013.01);
(Continued)

(58) Field of Classification Search
CPC ..... E04B 1/215; E04B 1/98; E04B 2001/405; E04B 2001/2415; E04B 1/2403;
(Continued)

(56) References Cited

U.S. PATENT DOCUMENTS 8,935,892 B2 * 1/2015 Buchanan ..... E04B 1/10 52/167.4
9,316,004 B1 * 4/2016 Hatzinikolas ..... E04F 13/14
(Continued)

FOREIGN PATENT DOCUMENTS

CN 106988551 * 7/2017 ..... E04G 23/0218

*Primary Examiner* — Andrew J Triggs
(74) *Attorney, Agent, or Firm* — Kyle R Satterthwaite; Ryan W Dupuis; Ade & Company Inc.

(57) ABSTRACT

Although Fiber Reinforced Polymers (FRPs), as alternatives for the corrosive steel reinforcement in concrete structures, have shown promising performance under gravity loads, their performance under reversal cyclic loading is still one of the main concerns. The linear behavior of FRP reinforcement has a two-sided effect on the seismic performance of FRP-reinforced concrete (RC) moment-resisting frames. Although the linear nature of FRP reinforcement could be advantageous in terms of limiting the residual damage after an earthquake event, it lowers the energy dissipation of the structure which can compromise its seismic performance. Disclosed herein is the addition of steel plates at selected locations in moment-resisting frames to improve seismic performance of FRP-RC structures while still being able to take advantage of its linear behaviour (minimal residual damage after earthquake). The effectiveness of the proposed solution was tested both experimentally and analytically.

31 Claims, 16 Drawing Sheets

Practical application to three dimensional interior beam-column joint

(51) Int. Cl.

| | |
|---|---|
| ***E04B 1/98*** | (2006.01) |
| ***E04B 1/24*** | (2006.01) |
| ***E04C 5/07*** | (2006.01) |
| ***E04B 1/38*** | (2006.01) |

(52) U.S. Cl.
CPC ..... *E04C 5/073* (2013.01); *E04H 9/025* (2013.01); *E04B 1/21* (2013.01); *E04B 2001/2415* (2013.01); *E04B 2001/405* (2013.01)

(58) Field of Classification Search
CPC . E04B 1/043; E04B 1/185; E04B 1/20; E04B 1/21; E04H 9/025; E04H 9/021; E04C 3/34; E04C 5/073
See application file for complete search history.

(56) References Cited

U.S. PATENT DOCUMENTS

| | | | | |
|---|---|---|---|---|
| 2011/0239581 | A1* | 10/2011 | Linares, III ..... | E04B 1/483 52/699 |
| 2014/0099456 | A1* | 4/2014 | Raghavendran ..... | B32B 13/02 428/34.4 |
| 2015/0322666 | A1* | 11/2015 | Hardy ..... | E04B 1/2403 52/700 |
| 2020/0263445 | A1* | 8/2020 | El-Salakawy ..... | E04H 9/025 |

* cited by examiner

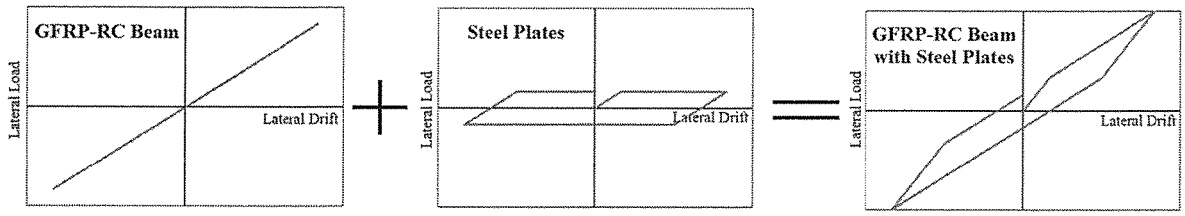
Figure 1 - Behaviour of GFRP-RC beams with steel plates
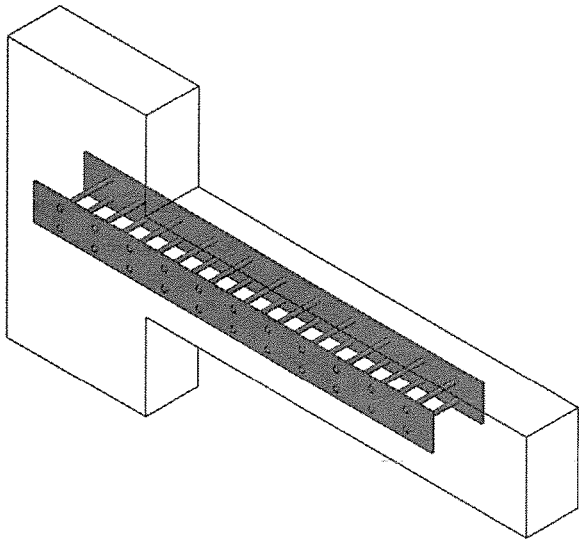
Figure 2 - Proposed mechanism for seismic performance enhancement of GFRP-RC elements
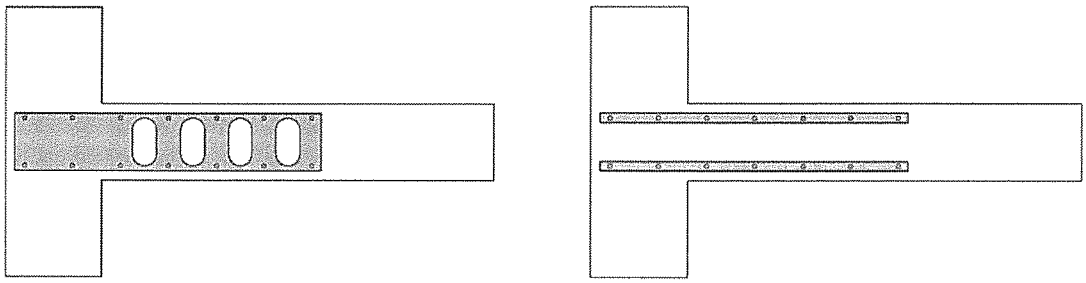
(a) Steel plates with holes (b) Steel straps
Figure 3 - Examples of alternative geometrical configuration for steel plates

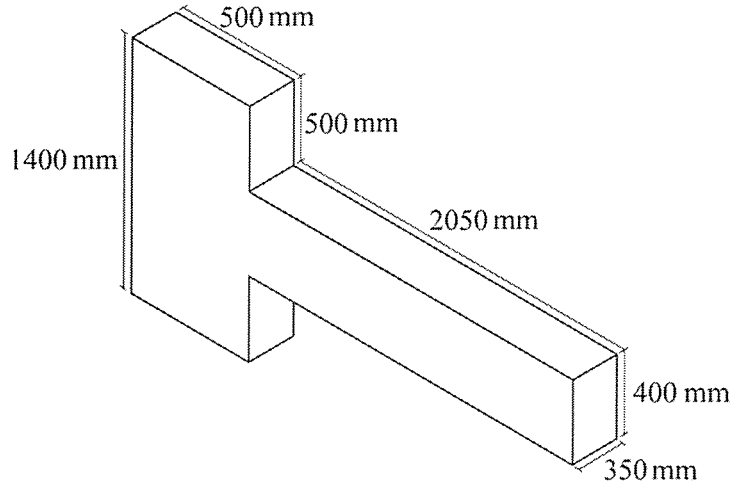
Figure 4 - Dimensions of test specimens (dimensions in mm)
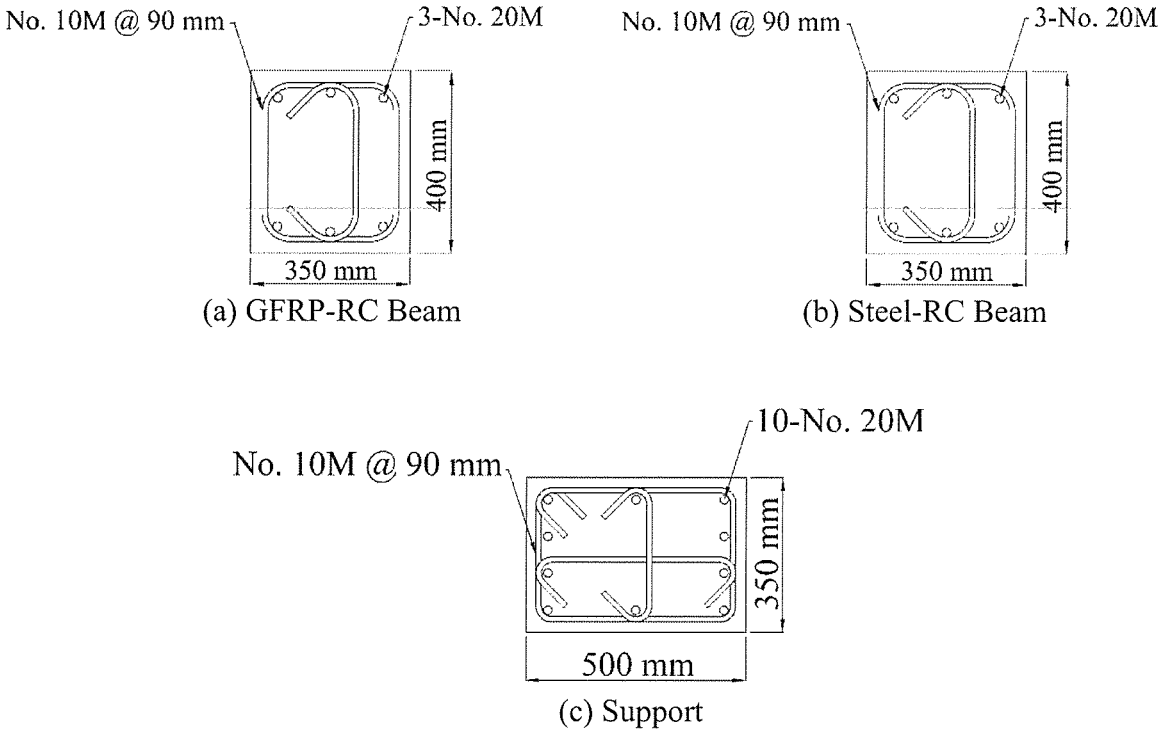
Figure 5 - Cross-sections of test specimens

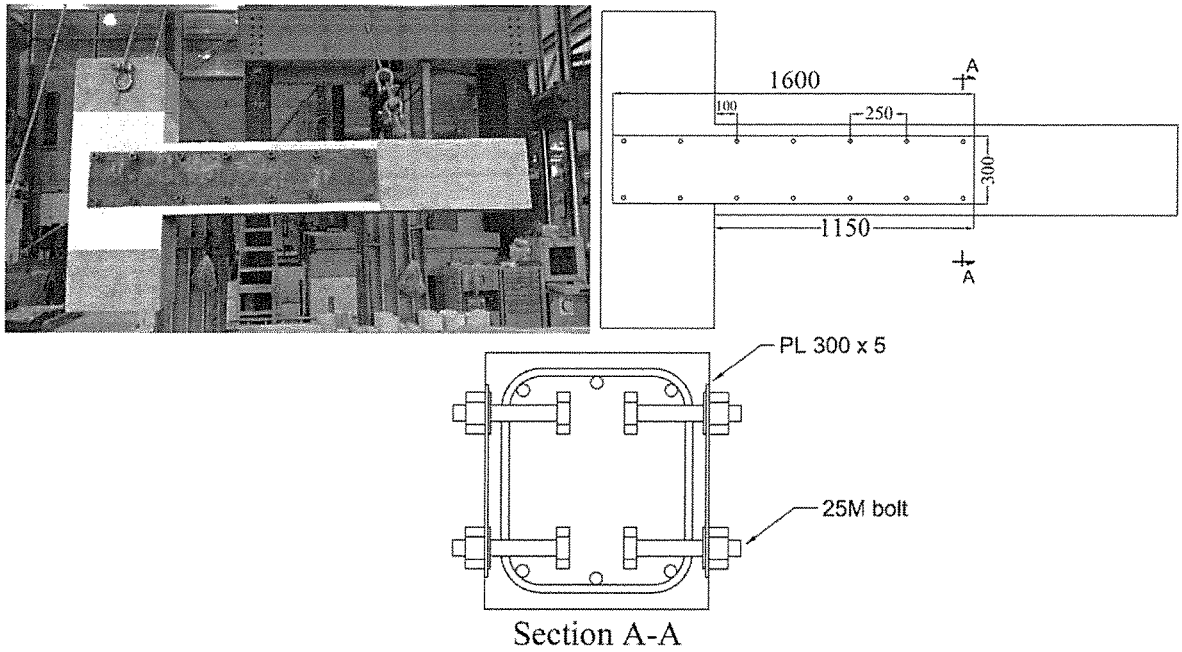
Figure 6 - Specimen G-M

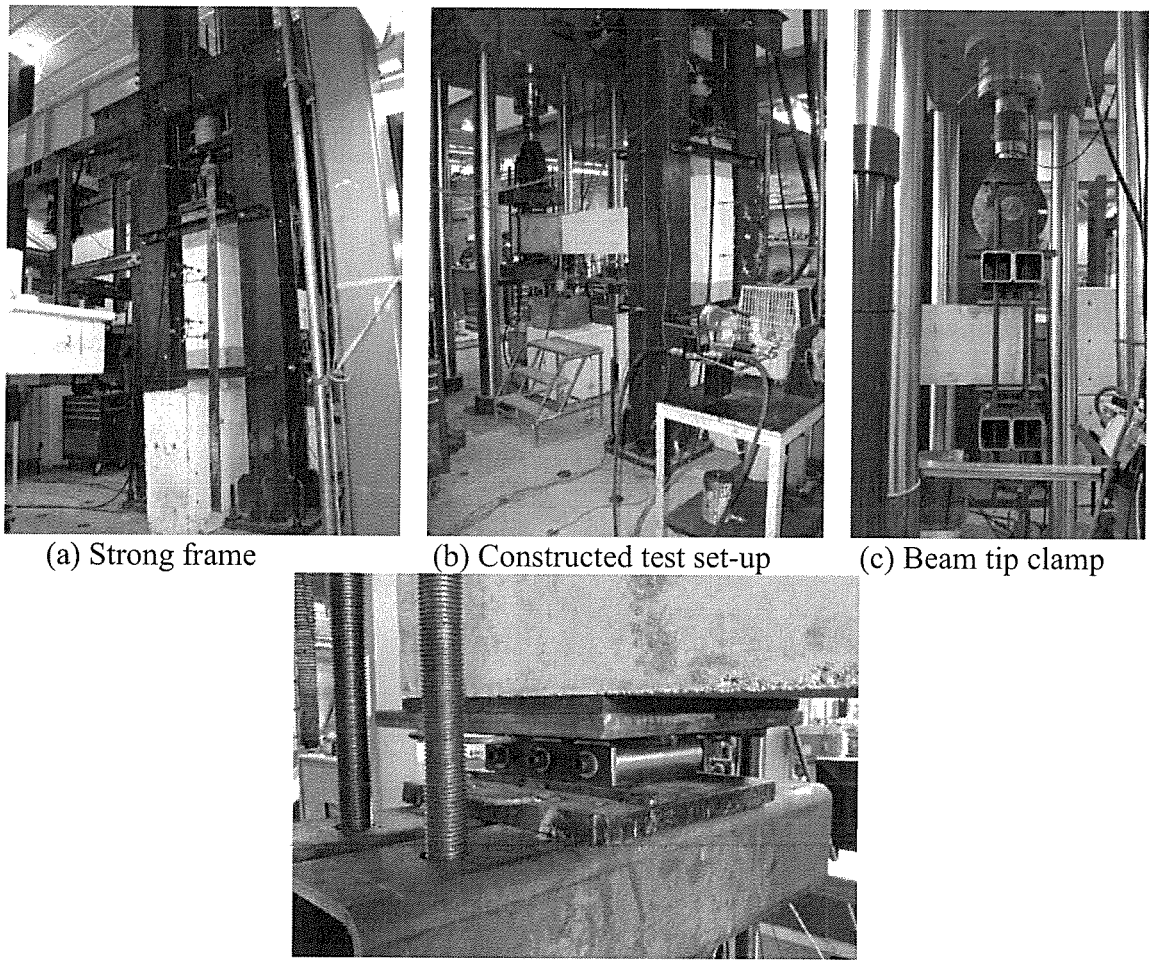
(a) Strong frame (b) Constructed test set-up (c) Beam tip clamp
(d) Rollers in beam tip clamp
Figure 7 - Test set-up
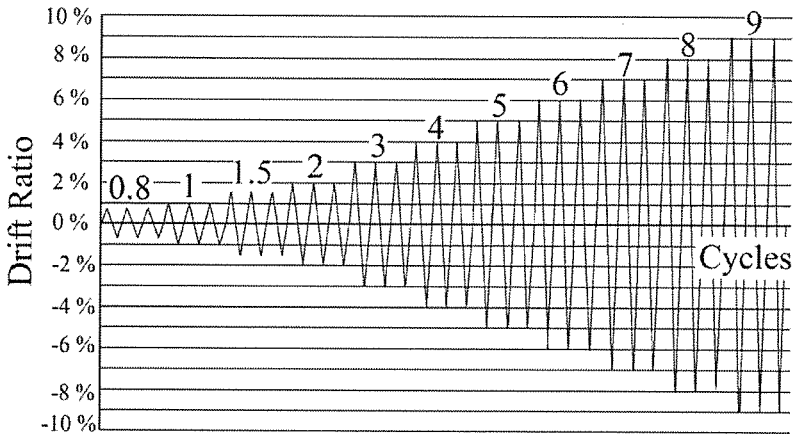
Figure 8 - Seismic loading scheme

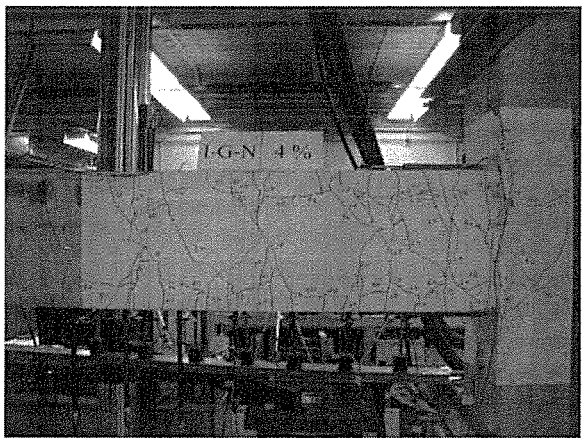
(a) Picture of Specimen G-N after 4% drift ratio
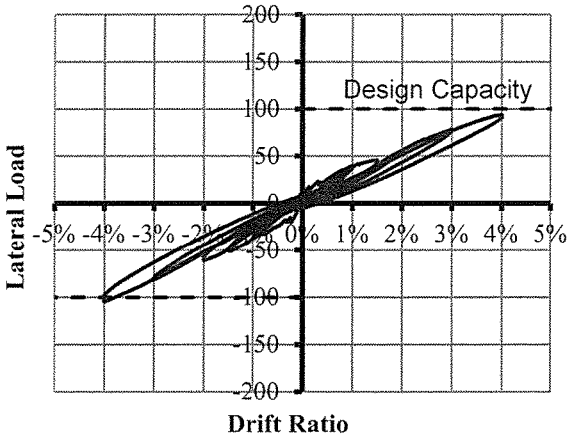
(b) Hysteresis diagram of Specimen G-N
Figure 9 - Specimen G-N after the first loading phase
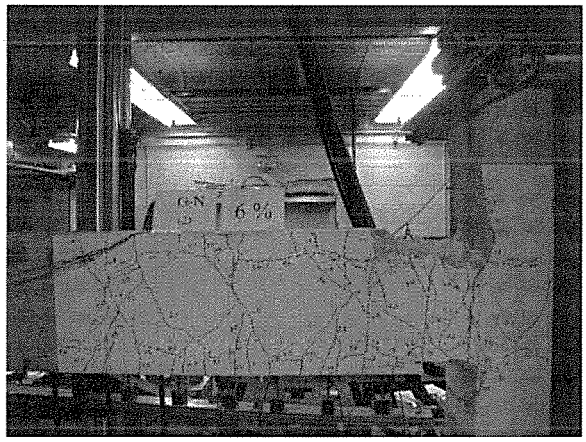
(a) Picture of Specimen G-N at failure
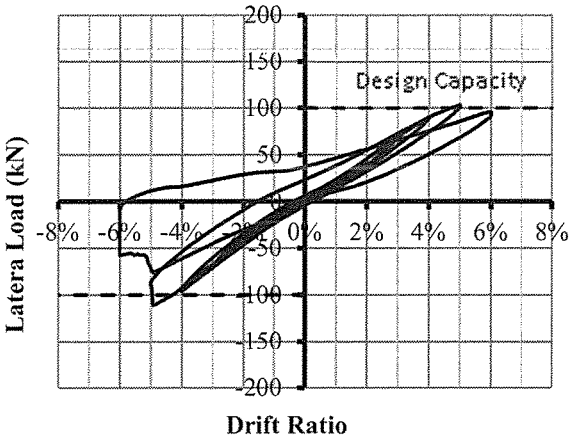
(b) Hysteresis diagram of Specimen G-N
Figure 10 - Specimen G-N after the second loading phase

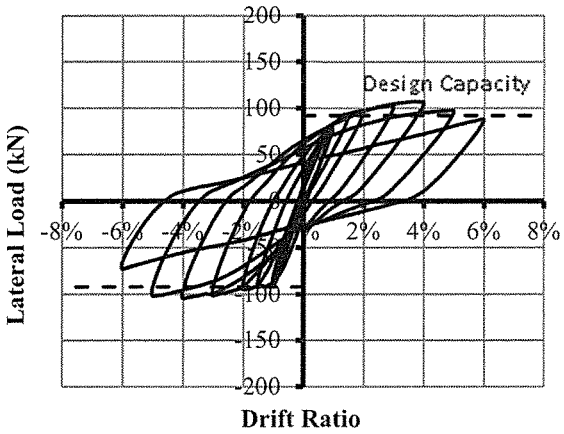
(a) Hysteresis diagram of Specimen S-N
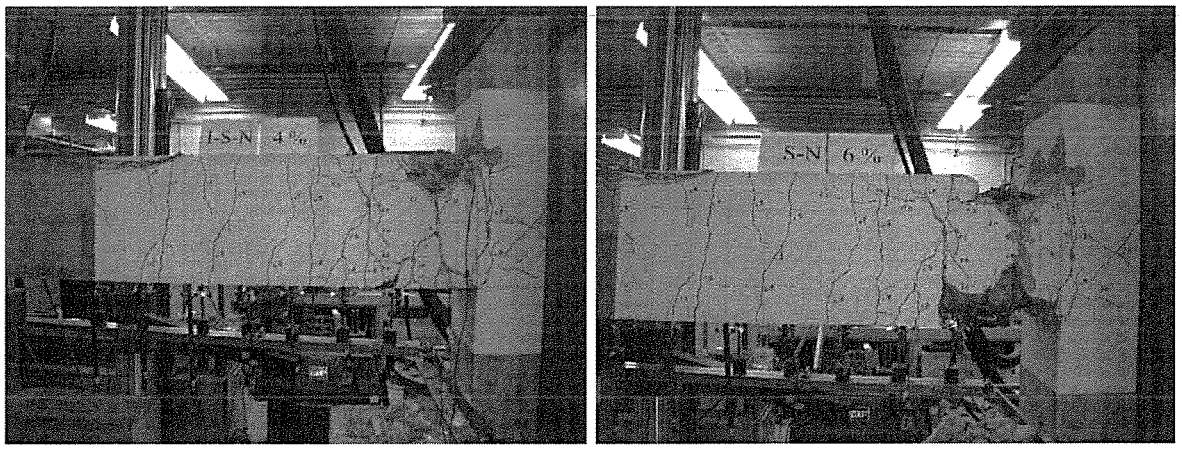
(b) Picture of Specimen S-N after 4% drift ratio (c) Picture of Specimen S-N at failure
Figure 11 – Performance of Specimen S-N

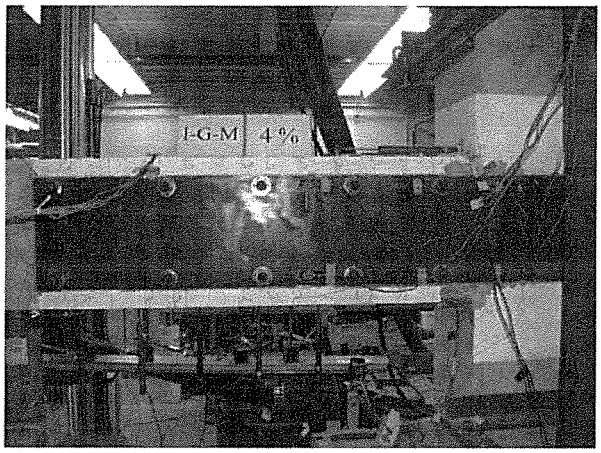
(a) Picture of Specimen G-M after 4% drift ratio
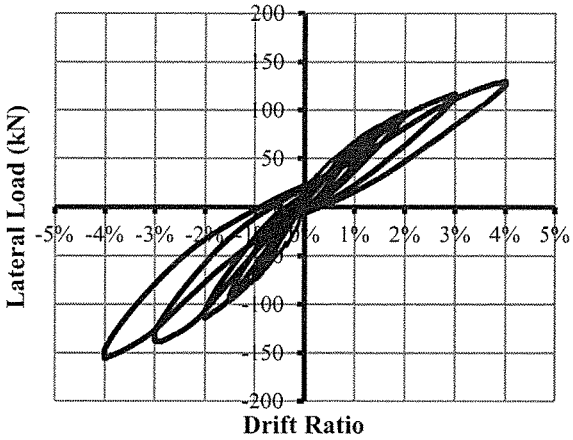
(b) Hysteresis diagram of Specimen G-M
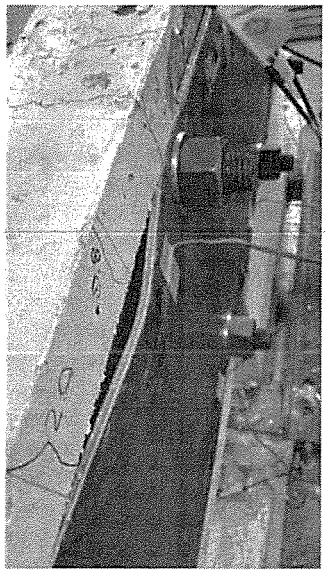
(c) Yielding of steel plates in Specimen G-M
Figure 12 - Specimen G-M after the first loading phase

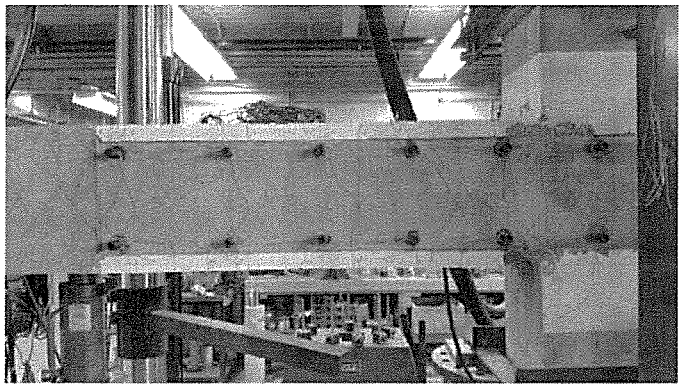
Figure 13 - Crack propagation in Specimen G-M after the first loading phase
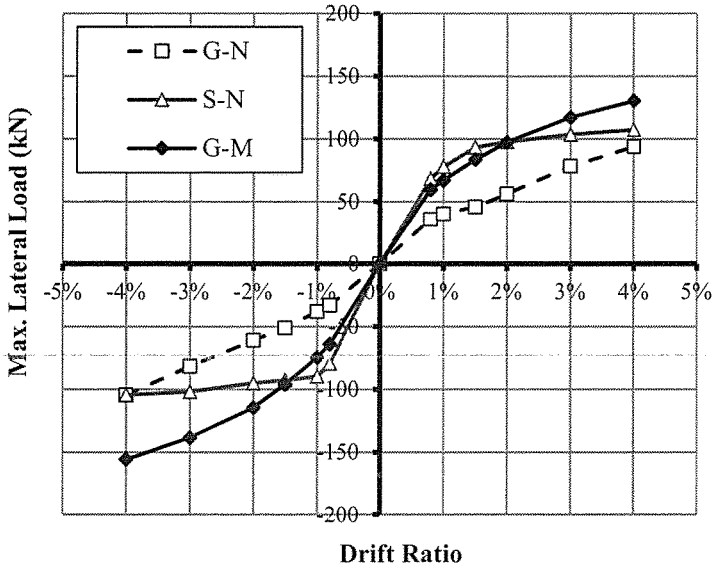
Figure 14 - Lateral load-drift envelop of specimens in the first loading phase
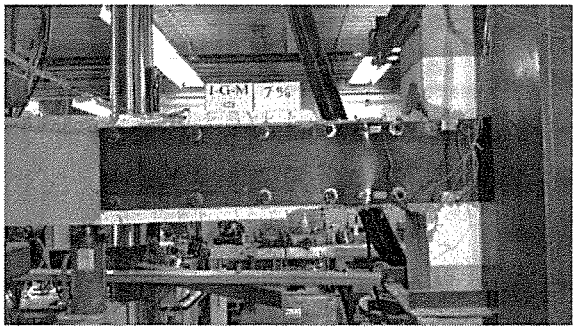
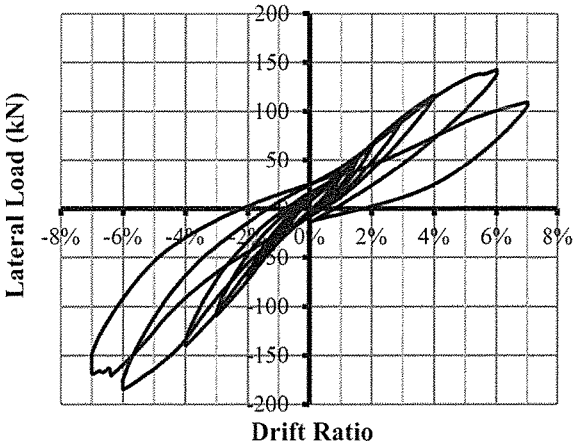
(a) Picture of Specimen G-M at failure (b) Hysteresis diagram of Specimen G-M
Figure 15 - Specimen G-M after the second loading phase

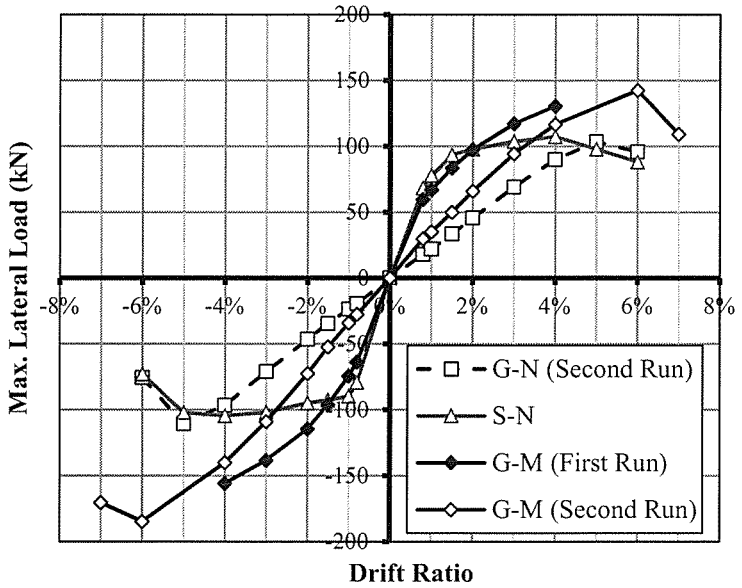
Figure 16 - Lateral load-drift envelop of specimens
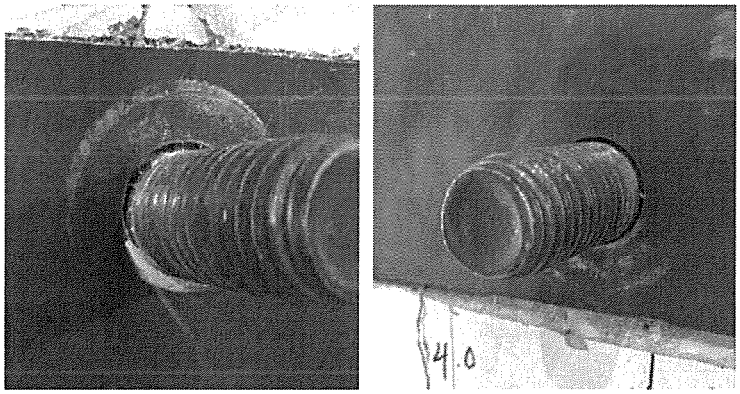
Figure 17 - Gap between bolts and steel plates after replacing damaged plates

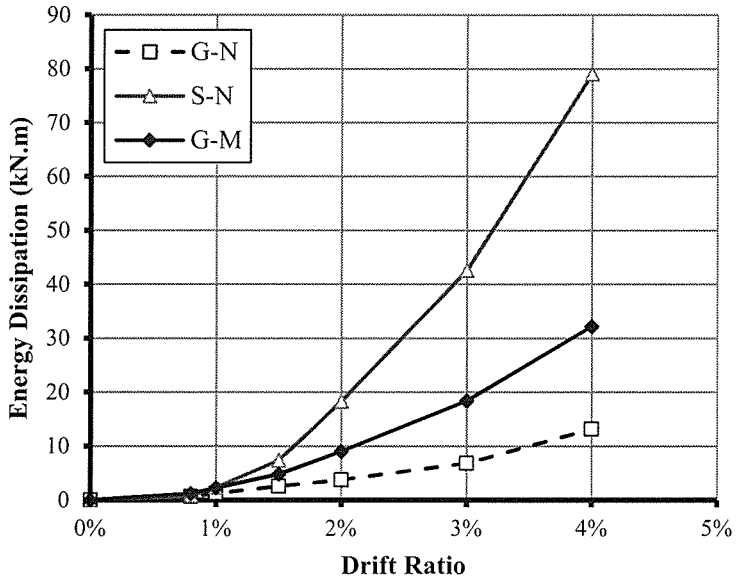
Figure 18 - Cumulative energy dissipation in the first loading phase
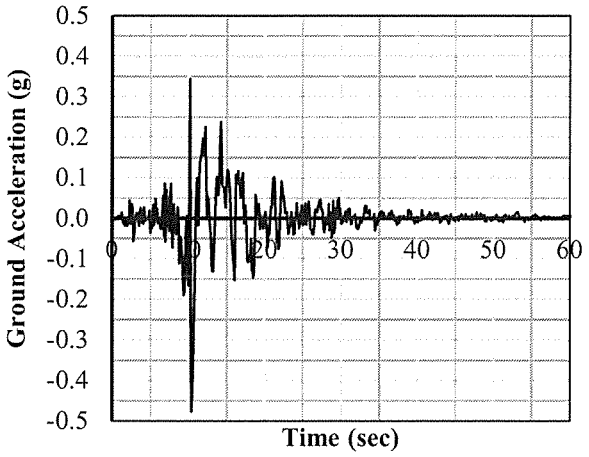
Figure 19 - Ground acceleration used for the dynamic analysis

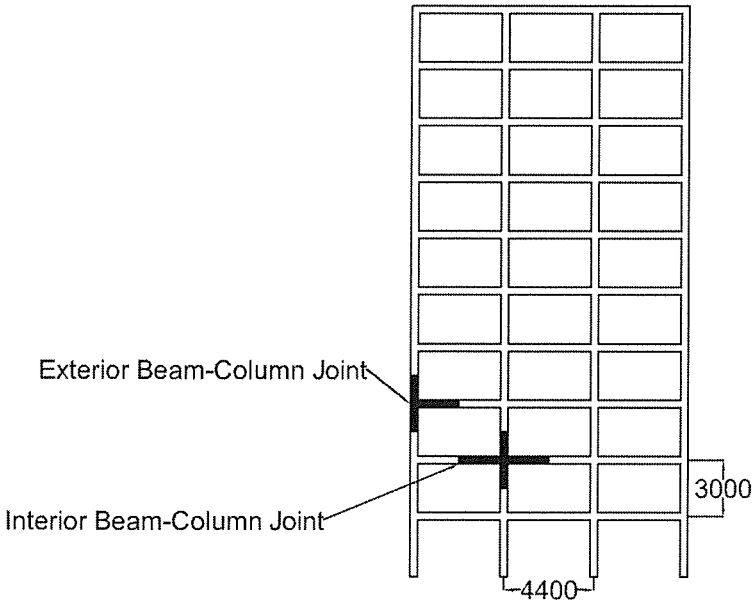
(a) Model geometry
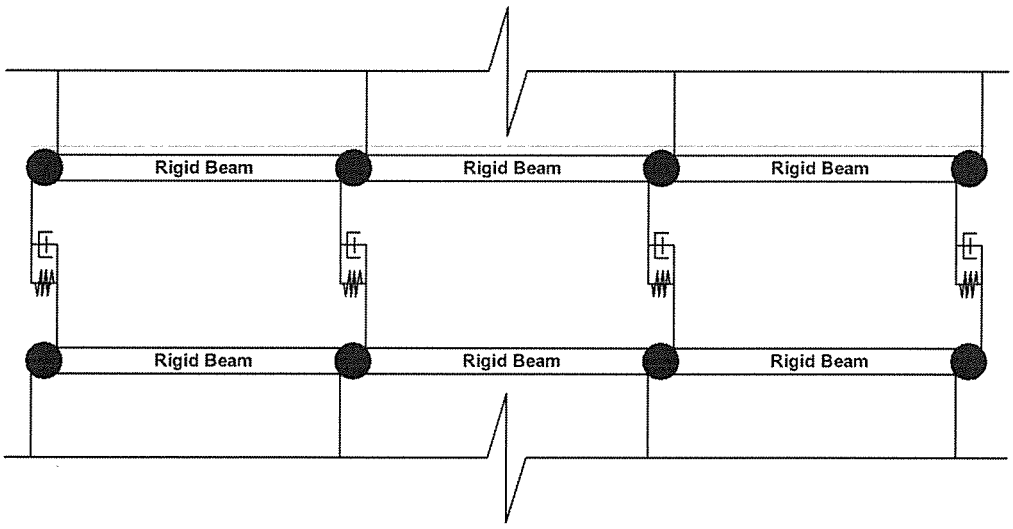
(b) Analytical model of one story
Figure 20 - The arbitrary frame for dynamic study

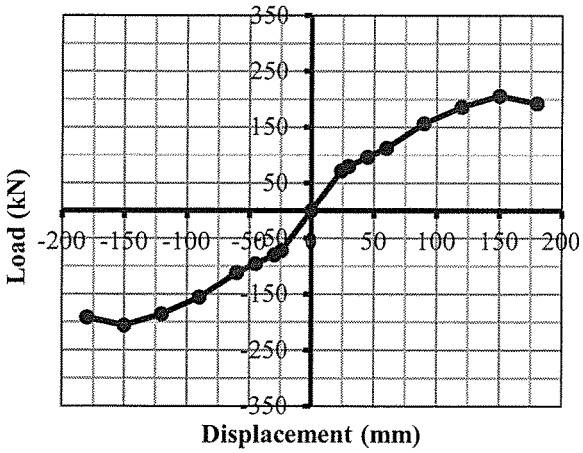
(a) Interior joints corresponding to G-N
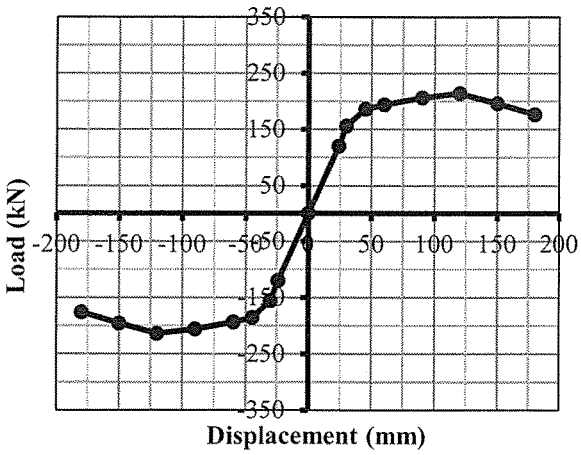
(b) Interior joints corresponding to S-N
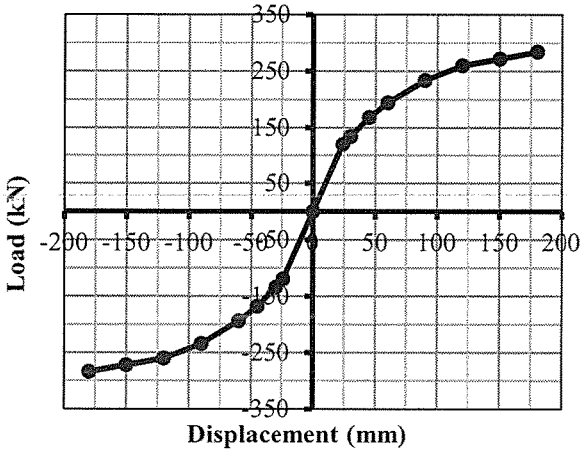
(b) Interior joints corresponding to G-M
Figure 21 – Load-displacement relationship of interior beam-column joints

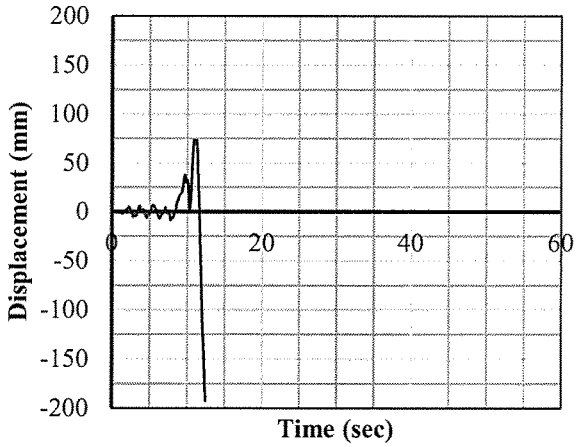
(a) Frame of Specimen G-N
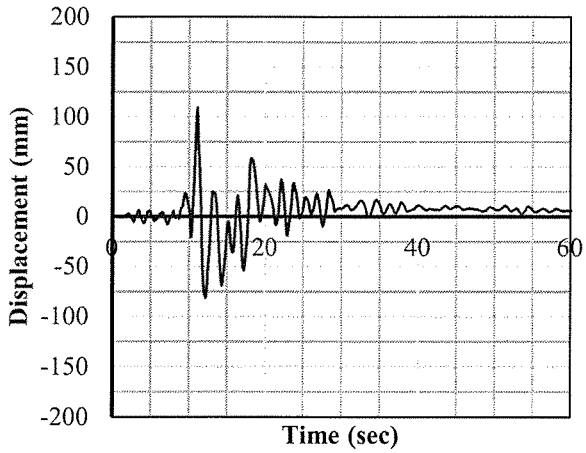
(b) Frame of Specimen S-N
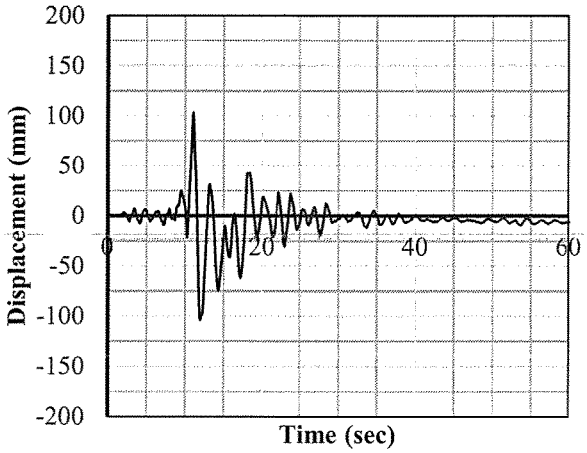
(c) Frame of Specimen G-M
Figure 22 - Lateral displacement response of analyzed frames: first story

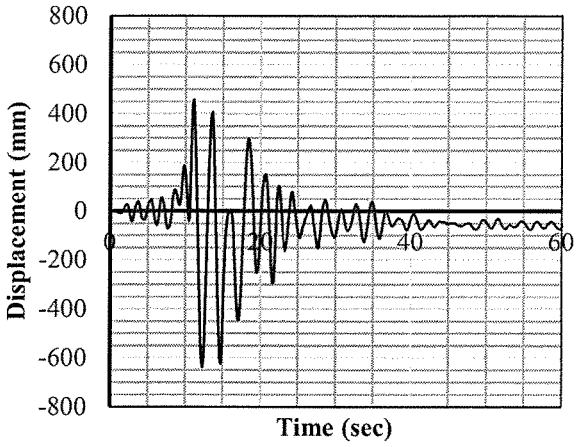
(a) Steel plates on the first two stories
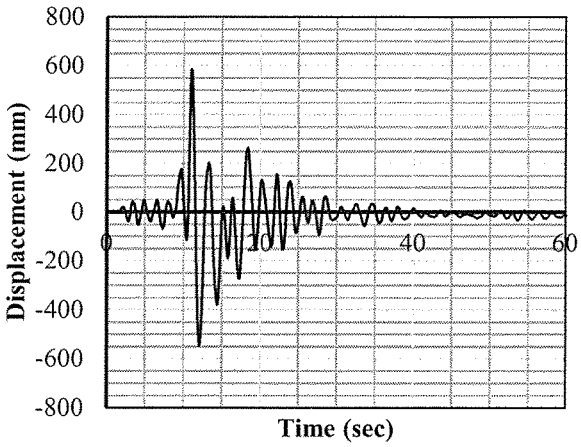
(b) Steel plates on the first six stories
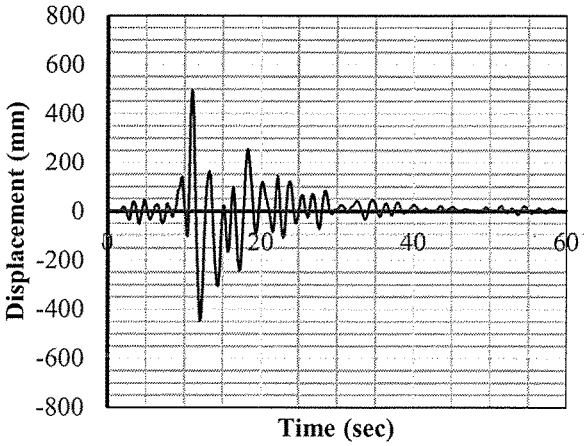
(d) Steel plates on all beam-column joints
Figure 23 - Lateral displacement response of analyzed frames: last story

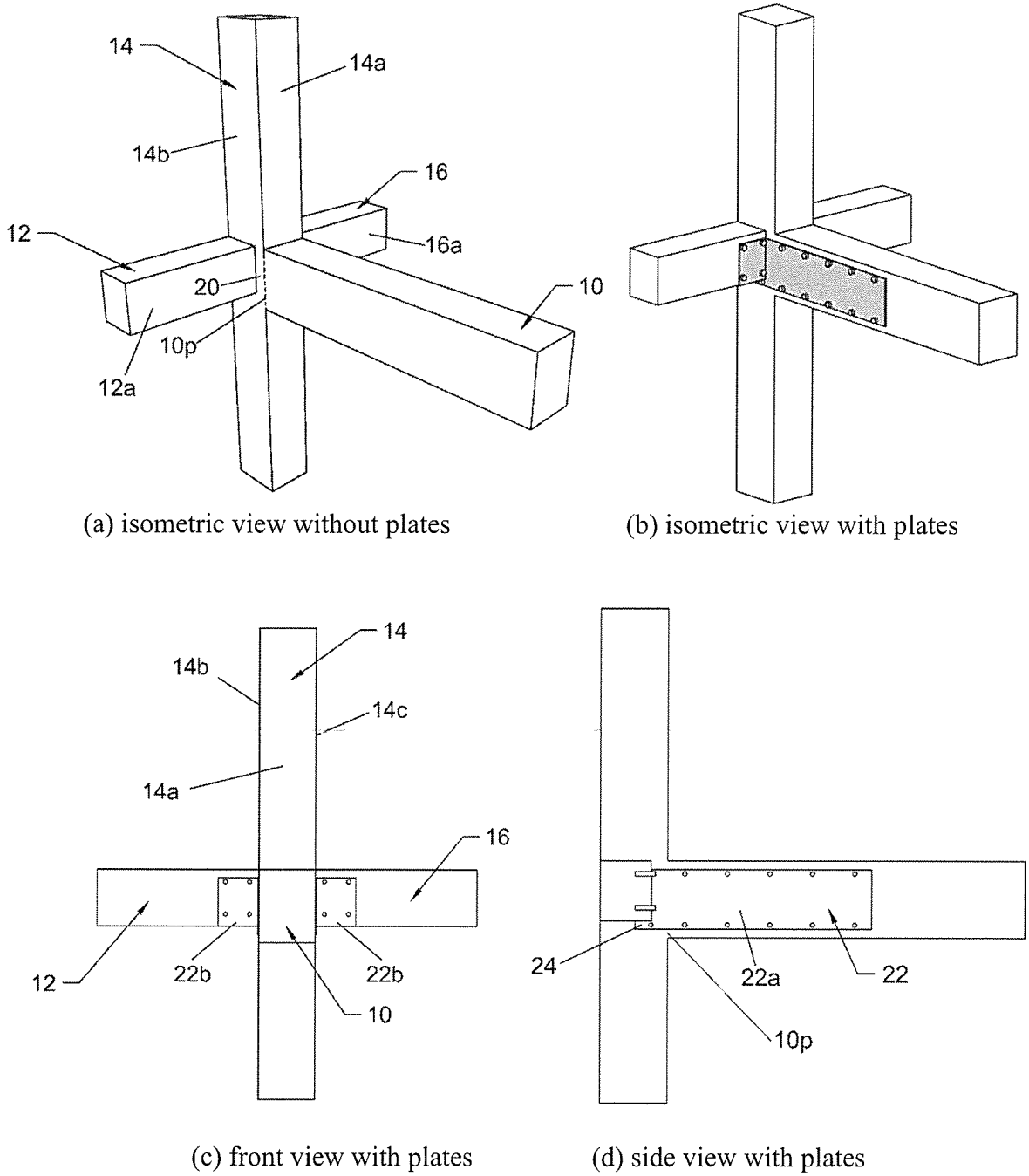
(a) isometric view without plates
(b) isometric view with plates
(c) front view with plates
(d) side view with plates
Figure 24 – Practical application to three dimensional exterior beam-column joint

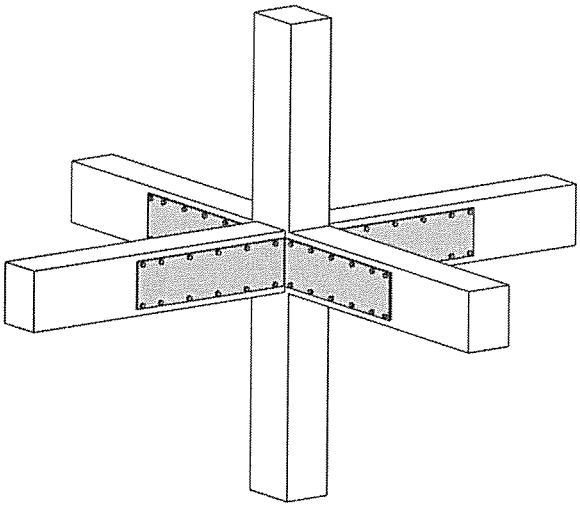
Figure 25 – Practical application to three dimensional interior beam-column joint

SEISMIC PERFORMANCE IMPROVEMENT OF FRP-RC STRUCTURES

FIELD OF THE INVENTION

The present invention relates generally to reinforced concrete structures, and more particularly to reinforced concrete structures with unique beam-column joints of improved seismic performance.

BACKGROUND

Superior behaviour of Fiber Reinforced Polymer (FRP) in terms of corrosion resistance, electrical and magnetic non-conductivity, and high strength-to-weight ratio introduced this material as a promising alternative for steel reinforcement in reinforced concrete (RC) structures. Up to date, many researchers have been involved in investigating the behaviour of various FRP-RC elements ranging from individual members such as beams and slabs to structural assemblies where two or more structural elements interact with each other, such as beam-column joints and slab-column connections.

Although performance of FRP-RC structures under monotonic loading has shown promising results toward replacing steel reinforcement with FRP, the performance of such structures under earthquake-induced loads is still a major concern. One of the main reasons is the linear behaviour of FRP reinforcement which results in lack of ductile behaviour of concrete structures under seismic loading. Therefore, without any special consideration, this linear behaviour could increase the probability of brittle failure and collapse of FRP-RC structures exposed to large deformations, such as moment-resisting frames in seismic regions.

Up to date, only few studies have been involved in investigating the seismic performance of FRP-RC frames (Ghomi and El-Salakawy 2016, Hasaballa and El-Salakawy 2016, Mady and El-Salakawy 2011, Said and Nehdi 2004, Fukuyama et al. 1995). To evaluate the seismic performance of FRP-RC frames, the majority of the researchers in this field focused on the behaviour of beam-column joints, as a key element in stability of frames, under lateral loading. Ghomi and El-Salakawy (2016), Hasaballa and El-Salakawy (2016), Mady and El-Salakawy (2011) investigated the feasibility of using FRP-RC beam-column joints in seismic regions and the effect of varies parameters on their seismic performance.

Results of these studies showed that beam-column joints reinforced with Glass Fibre Reinforced Polymers (GFRP) can be proportioned such that they are able to withstand high lateral drift ratios (9%) without exhibiting brittle failure due to rupture of the reinforcement. This observation was against what is generally expected from FRP-RC elements. This particular behaviour was observed in GFRP-RC members due to the relatively low modulus of GFRP (60 GPa) combined with relatively high tensile strength (1100 MPa), which makes these materials capable of withstanding high strains compared to the other main FRP alternatives, carbon FRP and aramid FRP.

Moreover, the test results indicated that GFRP-RC beam-column joints can maintain their elastic properties up to drift ratios as high as 5% with minimum residual damage. Due to this linear behaviour, replacing steel with GFRP materials might be an effective solution to eliminate the drastic damage caused by plastic deformation of steel-RC elements during an earthquake event. Damage to steel-RC structures after an earthquake can cause costly rehabilitation or even, in some cases, result in the demolition of the whole structure. Therefore, using concrete frames reinforced with FRP reinforcement (such as GFRP) in seismic regions can be a new approach toward earthquake-resistant structures since the frame could be capable of withstanding several severe ground shakings without significant residual damage.

However, despite the satisfactory performance of FRP-RC beam-column joints in terms of residual damage, these elements still show lack of energy dissipation which is one of the main philosophies for designing earthquake-resistant structures. Moreover, low modulus of elasticity of GFRP reinforcement decreases initial stiffness of RC moment-resisting frames which increases the lateral deformation of the frames during earthquakes. Large lateral deformation of the frames results in excessive secondary moments especially at the lower grades due to significant movement of the centre of gravity of the building from its original location. This effect is known as P-Δ effect. Moreover, large lateral deformation increases the pounding probability of adjacent buildings. Therefore, the advantage of FRP's linear behaviour cannot be utilized in eliminating the residual damage after an earthquake unless these two issues are addressed.

Accordingly, it remains desirable to improve the seismic performance of FRP-RC beam-column joints. In previous studies (Ghomi and El-Salakawy 2016, Hasaballa and El-Salakawy 2016), to compensate for low energy dissipation, researchers suggested to use conjugated lateral load resisting systems in FRP-RC frames; for example, using steel-RC shear walls or hybrid system frames (using FRP-RC elements only in surrounding parts of the frame that have direct contact with harsh environment while the core of the frame is reinforced with steel). However, these solutions are suggested based on the assumption that the main goal of using FRP reinforcement is to protect the structure against corrosion and not improving its seismic performance. Therefore, these solutions necessarily include using steel-RC elements in some parts of the frame which again increases the probability of permanent deformation after an earthquake.

Up to date, no solution has been introduced to improve energy dissipation or low initial stiffness of FRP-RC elements, which seems to be the only reason for holding back FRP-RC moment-resisting frames from being eligible for resisting lateral seismic loads by themselves.

The inventors of the present application focussed on conjugating FRP-RC frames with simple and easy-to-install mechanical devices to improve their seismic performance. The approach is to improve the overall performance of GFRP-RC frames (or any other type of FRP-RC frame with similar behaviour) by installing the device on the beam-column joints in the frame. In this approach, the energy dissipation and initial stiffness of FRP-RC joints will be improved while still possible to take advantage of the linear behaviour nature of the structure.

The conventional approach to design an earthquake-resistant RC structure is based on members' plastic deformation mainly due to yielding of reinforcing steel. Ductility of steel-RC structures provides significant energy dissipation due to inelastic deformation of members. This plastic deformation; however, comes with the cost of severe damage to the elements after an intense earthquake. In some cases, the damage is so drastic that the structure may need to be demolished.

Investigating new approaches for designing earthquake-resistant structures always has been undertaken by engineers. There are two main paths that have been followed to improve the dynamic response of structures: 1) seismic isolation, and 2) providing additional energy dissipating systems (damping). In the isolation approach, the base of the structure is decoupled from the superstructure. In the damping approach, on the other hand, the focus is not on limiting the force transmitted to the structure, but rather on dissipating the seismic energy by means of additional damping devices in a way that structural elements remain in the elastic behaviour phase (Duggal 2014).

Lack of plastic deformation in FRP-RC structures, despite eliminating costly repairs after earthquakes, significantly decreases the amount of seismic energy dissipated by the structure. In this case using one of the mentioned approaches (isolation or damping) may be effective to improve the dynamic response of GFRP-RC moment-resisting frames.

However, using base isolation approach may not be as effective as using additional damping systems in the case of GFRP-RC frames. Base isolation is mostly recommended for relatively stiff structures. It may not be suitable for GFRP-RC frames because of large deflection possibilities. Moreover, base isolation is generally a complex and expensive procedure (Duggal 2014).

Using additional damping mechanism, on the other hand, seems to be very suitable for GFRP-RC frames. There are many damping mechanisms available for the construction industry; however, it remains desirable to introduce an easy-to-build damping system with relatively low cost. Since beam-column joints are the main elements for dissipating energy in moment-resisting-frames to endure lateral loads, it seems reasonable to introduce a mechanism that can enhance energy dissipation feature of GFRP-RC beam-column joints while maintaining their linear behaviour nature.

SUMMARY OF THE INVENTION

According to a first aspect of the invention, there is provided beam-column joint at an integral juncture between a concrete column and a concrete beam that are integrally and directly attached to one another by concrete of said concrete column and concrete beam, said beam-column joint comprising internal reinforcements of fiber reinforced polymer embedded within integrally and directly interconnected concrete cores of said concrete column and said concrete beam, and said beam column joint further comprising at least one external member attached to said concrete beam and spanning across said juncture in external relation to said concrete column and said concrete beam.

According to a second aspect of the invention, there is provided concrete multi-story moment resisting frame comprising intersecting columns and beams, said multi-story moment resisting frame comprising beam-column joints of the type according to the first aspect of the invention at one or more lower stories of said multi-story moment resisting frame, and also comprising one or more upper stories lacking the external members of said beam-column joints found in the one or more lower stories.

According to a third aspect of the invention, there is provided a method of repairing a seismically damaged concrete moment resisting frame that comprises intersecting columns and beams, at least some of which are joined together by beam-column joints of the type according to the first aspect of the invention, said method comprising substituting a replacement external member for a damaged external member at one or more said beam-column joints.

According to a fourth aspect of the invention, there is provided a method of improving the seismic resistance of a beam-column joint at which a concrete column and a concrete beam meet one another and are integrally and directly attached to one another by concrete of said concrete column and said concrete beam, and within which fibre reinforced polymer reinforcements embedded within integrally and directly interconnected concrete cores of said concrete column and said concrete beam, the method comprising externally attaching at least one external member to the concrete beam in a position spanning across a juncture between said concrete beam and said concrete column.

The present invention thus introduces a method to design deformable reinforced concrete moment-resistant structural system capable of resisting high intensity lateral loads. The lateral loads may be due to earthquake, wind or other sources. The invention provides a framed structure with sufficient initial stiffness and ductility to resist lateral loads, while providing fast, easy and cost-effective repairing process following the application of lateral loads to restore the initial properties of the structure. The invention can be used as the lateral load-resisting system solely or in conjunction with regular FRP-RC moment-resisting frames or shear walls. The invention may be used in buildings, bridges or any other structural systems. The method may be implemented in new structures or in rehabilitation of existing structures.

BRIEF DESCRIPTION OF THE DRAWINGS

One embodiment of the invention will now be described in conjunction with the accompanying drawings in which:

FIG. 1 illustrates behaviour of GFRP-RC beams with steel plates attached thereto according to the present invention.

FIG. 2 schematically illustrates a beam-column joint of a moment resisting frame with attached steel plates according to the present invention.

FIG. 3 schematically illustrates examples of alternative geometrical configuration for steel plates FIG. 4 illustrates the shape of concrete beam-column joint specimens used in experimental testing of the present invention.

FIG. 5 illustrates cross-sections of concrete beam and concrete column of the specimens.

FIG. 6 illustrates side views and a cross-sectional view of a test specimen including steel plates attached to a GFRP-RC beam according to the present invention.

FIG. 7 illustrates an experimental setup used to the test the present invention.

FIG. 8 illustrates cyclic loading scheme used in the experimental test procedure.

FIG. 9 illustrates results of a GFRP-RC control specimen lacking the steel plates of the present invention after a first loading phase of the experimental test procedure.

FIG. 10 illustrates the control specimen of FIG. 8 after a second loading phase of the experimental test procedure.

FIG. 11 illustrates results a steel reinforced control specimen lacking the present invention's combination of GFRP internal reinforcements and externally attached steel plates.

FIG. 12 illustrates results of the FIG. 5 test specimen employing the inventive combination of a GFRP-RC beam with externally attached steel plates after the first loading phase.

FIG. 13 illustrates the test specimen of FIG. 11 with the external steel plates removed.

FIG. 14 illustrates lateral load-drift envelops of the control and test specimens in the first loading phase.

FIG. 15 illustrates results of the FIG. 12 test specimen after installation of new replacement plate and application of the second loading phase.

FIG. 16 illustrates lateral load-drift envelops of the control and test specimens in the second loading phase.

FIG. 17 illustrates gaps between concrete embedded support bolts of the GFRP-RC beam and the replacement steel plates in the FIG. 14 test specimen.

FIG. 18 illustrates cumulative energy dissipation in the first loading phase for the control and test specimens.

FIG. 19 illustrates ground acceleration conditions used in a computer model simulation of a moment resisting frame using the unique beam-column joint structure of the present invention.

FIG. 20 schematically illustrates the geometry and analytical module used in the computer simulation.

FIG. 21 illustrates load-displacement relationships among the control and test joints run through the computer simulation.

FIG. 22 the lateral displacement response among the control and test joints run through the computer simulation.

FIG. 23 illustrates the lateral displacement response from computer simulation modules in which the inventive beam-column joints are employed only among lower stories of a moment resisting frame.

FIG. 24 schematically illustrates one embodiment of a three-dimensional multi-beam GFRP-RC joint to which steel plates are attached according to the present invention.

FIG. 25 schematically illustrates another embodiment of a three-dimensional multi-beam GFRP-RC joint to which steel plates are attached according to the present invention.

DETAILED DESCRIPTION

In the present application, attachment of external steel plates to beam-column joints is proposed as an effective solution to improve dynamic performance of FRP-RC frames. It should be mentioned that steel has been chosen as an example of a suitable material for these external plates, but any other material with similar properties may alternatively be used, for example including shape memory alloys. However, for consistency, the words "steel" and "metal" are primarily used herein in relation to the externally attached plates of the unique beam-column joint.

In this approach, plastic behaviour of steel is used to dissipate energy and high modulus of elasticity of steel is used to increase initial stiffness of the frames. In the proposed apparatus and method, the concrete section is internally reinforced with GFRP bars and is designed based on GFRP material characteristics. A metal member (e.g. steel plates), then, will be added to the section in order to dissipate energy through plastic deformations while the member undergoes large drift ratios. The metallic member is attached to the structure externally. Assuming perfect linear and bi-linear stress-strain relationship for GFRP-RC beams and steel plates, respectively, schematic behaviour of a GFRP-RC beam with a steel plate is shown in FIG. 1. Similar to the steel plates, GFRP internal reinforcement could be replaced with any other FRP material with similar properties; however, for consistency only the word "GFRP" will be used hereafter.

FIG. 2 schematically shows attachment of steel plates to a basic two-dimensional beam-column T-joint featuring a singular GFRP-RC beam horizontally cantilevered from one side of a vertical concrete column. This GFRP-RC structure, in a known manner, features internal reinforcements formed of GFRP, typically including GFRP bars and GFRP stirrups, as illustrated in later figures referenced below. As shown, one steel plate is attached on each side of the concrete beam. The illustrated steel plates are of elongated rectangular shape, whereby the longer dimension of the steel plate lies parallel to the longitudinal direction of the beam. In the illustrated example, the beam is of equal width to the column, and each side of the beam is flush with a respective side of the column. Each steel plate overlies the respective side of the beam, and reaches past a proximal end of the beam where the beam joins with the column, such that the steel plate spans across this juncture of the beam and column and thus also overlies the respective coplanar side of the column. It should be mentioned that here rectangular steel plates were used as an example and any other geometrical configurations that provide the desired advantages could be considered. Two possible configurations, steel plates with holes and steel straps, are shown in FIG. 3 as examples. Accordingly, the tetra external member is used in select passages herein to encompass plates, straps and other shape possibilities for these components.

The plates are tied to both the concrete beam and the concrete column by several threaded support elements (e.g. structural bolts, or cast-in anchors) partially embedded in the concrete core of the beam and column during casting thereof so that part of support element's threaded shaft projects externally outward from the side of finished beam/column. Each metal plate has an array of fastener holes through which the threaded shafts of the support elements project from the side of the beam and column. Accordingly, fastened attachment of the metal plate to the concrete core of the beam and column requires mere engagement of nuts onto the protruding shafts of the support elements in order to clamp the plate in place against the side of the concrete. This fastened anchoring of the plates to the beam is to ensure that the plates deflect with the same curvature as the concrete beam. The idea is to dissipate seismic energy by plastic deformation of the plates after yielding. The damaged and deformed plates following an earthquake will be replaced with new plates. As mentioned before, since GFRP-RC frames can undergo large deformations while maintaining their linear nature and original condition (to an acceptable degree), replacement of damaged steel plates with new ones restores the original condition of the structure with no need for additional repair. This feature is one of the key advantages of the proposed structure over a conventional steel-RC structure. In an internally steel-RC frame, since there is no access to the embedded reinforcement, the original condition can never be restored once yielding of the reinforcement has occurred.

Prior to pouring of the concrete, the steel plates may be placed over the ends of the support elements inside the formwork being used to cast the concrete. This way, during the casting process, the flowable concrete will inherently fill any small gaps between the diameter of the threaded shaft and the respective fastener hole in the plate to optimally fix the shaft in stationary relation to the beam. Alternatively, rather than installing both the partially embedded support elements and the steel plates during casting of the concrete, the plates may alternatively be installed after the casting process, by sliding the fastener holes of the plate over the matching layout of cast-in support elements, and then threading the nuts onto the shafts of the support elements that project through the fastener holes. In such post-casting installation of the plates, grout is injected into the gap openings around the threaded shafts of the support elements inside the fastener holes of the plate before sealing the openings closed with washers and nuts. This filling of the gaps with grout thereby compensates for the lack of concrete between the shafts and fastener holes in the event of such post-casting installation of the plates.

In the present disclosure, greater focus is made on the linear behaviour of GFRP-RC members and their ability to withstand large deformations than on their corrosion resistance, the latter of which is typically considered the conventional motivation for replacing steel reinforcement with GFRP material. Instead, the focus herein is on achieving a new type of structure with improved seismic performance compared to the structures that are solely reinforced with steel or GFRP.

Therefore, using corrodible steel plates in a GFRP-RC frame of the present invention will not interfere with this goal since the focus is not specifically on achieving a corrosion-resistant structure. However, the proposed frame structure does have superior behaviour in terms of controlling corrosion of steel components compared to conventional steel-RC structures. This is because the main metallic components of the proposed structure are situated externally of the concrete, and thus visually and physically accessible, whereby corrosion assessment and prevention are more convenient compared to the structures that are internally reinforced with steel reinforcement. Moreover, corroded steel plates can be easily replaced with new plates if needed, by unfastening the nuts and removing the corroded plates, and substituting same with a replacement set of non-corroded plates.

To evaluate the effectiveness of the proposed solution on the seismic performance enhancement of GFRP-RC moment-resisting frames, three full-scale cantilever beams (one steel-RC, one GFRP-RC and one GFRP-RC with steel plates) were constructed and tested under reversal-cyclic loading.

Specimens

The test specimens were identically sized beams of the shape and dimensions shown in FIG. 4, and which differed from one another only in the type of internal reinforcement within the beam (GFRP or steel) and the presence or lack of the externally attached steel plates. The beam's internal reinforcement was anchored in a 350×500×1400-mm concrete block which simulated a fixed support column, thus resulting in a beam-column T-joint of the type described above and illustrated in FIG. 2.

Two of the T-joints were used as control specimens with no steel plates, one representing a GFRP-RC joint and one representing a conventional steel-RC joint. The control joints were designed to have the same flexural capacity.

FIG. 5 shows reinforcement detailing of the specimens. Deformed (ribbed) steel and GFRP bars and stirrups were used to provide sufficient bond between the internal reinforcement and the concrete. The longitudinal bars of the beam were anchored into the concrete column support with a 90 degree standard bend.

Test results of the control specimens were used to investigate the differences between the seismic behaviour of GFRP-RC structures and steel-RC ones. Moreover, the results drew guidelines to assess the effectiveness of the proposed method of increasing energy dissipation of the GFRP-RC beams using the steel plates.

The third specimen was constructed by replicating the control GFRP-RC beam, but with addition of the steel plates in the manner described above with reference to FIG. 2. FIG. 6 shows a detailed drawing and pictures of the test specimen. Two 1600×300×5-mm steel plates were attached, one on each side of the beam, by means of fourteen 8-200 mm-long 25M bolts.

The control and test specimens were each assigned a two-letter designation. The first letter indicates the type of internal reinforcement material ("G" for GFRP, and "S" for steel). The second letter indicates whether the steel plates are attached to the specimens ("N" for the specimens with no plates, "M" for the specimen with the metallic plates). Table 1 shows properties of test specimens.

TABLE 1

Properties of control specimens

| | Beam Reinforcement (Top and Bottom) | Beam Flexural Capacity (kN · m) | Support Flexural Capacity (kN · m) | Concrete Strength (MPa) |
|---|---|---|---|---|
| G-N | 3-No. 20M | 231 | 420 | 47 |
| S-N | 4-No. 20M | 214 | 420 | 47 |
| G-M | 3-No. 20M | 336 | 420 | 49 |

Materials

The specimens were cast with ready-mix concrete with a target 28-day strength of 40-MPa, normal weight and maximum aggregate size of 20-mm. The actual concrete compressive strength of the specimens was obtained based on standard 150×300-mm cylinder test on the day of testing, as reported in Table 1.

Deformed CSA grade G400 regular steel bars were used in the steel-RC specimen. The average yield and tensile strengths of the longitudinal bars, 440 and 620 MPa, respectively, were obtained in the laboratory according to CSA/A23.1-14 (CSA 2014). Deformed GFRP bars and stirrups (Schoeck 2014) were used in the GFRP-RC specimens. The mechanical characteristics and dimensions of used GFRP reinforcement, as provided by the manufacturer, are listed in Table 2.

TABLE 2

Mechanical properties of used GFRP reinforcement

| Configuration | Bar designation | Diameter (mm) | Area ($mm^2$) Nominal | Area ($mm^2$) Annex A (CSA-S806-12) | Tensile strength Straight portion (MPa) | Elastic Modulus (GPa) | Ultimate strain (microstrain) |
|---|---|---|---|---|---|---|---|
| Bent bar | 20M | 20 | 314 | 392 | 850 | 50 | 17,000 |
| Stirrups | 10M | 12 | 113 | 166 | 1,000 | 50 | 20,000 |

Test Set-Up

FIG. 7 shows pictures of the test set-up with a specimen ready for testing. A 5,000-kN-capacity actuator on a "Material Testing Systems" (MTS) loading frame was used to apply reversal-cyclic displacements to the distal tip of the beam to simulate seismic loading. The support column of the cantilever beam was under constant axial load during the test, by means of a hydraulic jack. A strong frame was used to provide sufficient support for the jack (FIG. 7(*a*)). The top and bottom of the concrete support column were clamped to the frame to prevent any lateral movement.

The actuator was attached to the distal tip of the beam by means of a swivel head to prevent any moment application. Moreover, a set of rollers were put between the concrete beam and loading plates to prevent the actuator from applying unwanted axial loads to the beam during the reversal vertical loading.

Loading Procedure

The loading procedure was started by applying axial compressive load to the support column portion. The magnitude of the load was equal to 15% of maximum concentric capacity of the support column. This load remained constant during the testing procedure.

Following the support column loading, the reversal-cyclic loading of the beam started. The loading was in a displacement-controlled mode. FIG. 8 shows the cyclic loading scheme used in the testing procedure. A series of loading stages progressively increasing in lateral drift ratio was applied to the specimens according to the ACI 374.1-05 (ACI 2005) "Acceptance criteria for moment frames based on structural testing". The drift ratio is defined as the angular rotation of the column chord with respect to the beam chord, which in the present test set-up configuration was calculated as relative displacement of beam tip to its length. Moreover, three identical loading cycles for each drift ratio were applied to achieve stable crack propagation in the specimens.

As mentioned earlier, one aspect of this undertaking was to evaluate the ability of GFRP-RC elements to maintain their original condition after being loaded to high drift ratios. Therefore, the GFRP-RC specimens were tested under two series of cyclic loading. In the first series, they were loaded under the above specified loading procedure up to 4% drift ratio. In the second series, the loading scheme was repeated from 0% drift ratio and was continued until failure of the specimens. It should be mentioned that according to ACI 374.1-05 (ACI 2005), failure is defined when at least 25% decrease in lateral load-carrying capacity of the specimens compared to the maximum observed capacity is occurred.

This two-phase loading procedure was to investigate the performance of the GFRP-RC beams after undergoing a severe seismic loading and to measure possible stiffness reduction. The reasons for choosing the 4% drift ratio as the limit for the first loading step are as follows:

1. Previous studies on the seismic behaviour of GFRP-RC beam-column joints (Ghomi and El-Salakawy 2016) indicated that the specimens generally achieve their design capacity at 4% drift ratio. Therefore, to evaluate the seismic performance of the GFRP-RC test beams after being loaded to their maximum design capacity, 4% drift ratio was selected.
2. Moreover, any drift ratios higher than 4% is considered to be beyond the actual response of a regular moment-resisting frame. The National Building Code of Canada (NRCC 2015) limits the maximum allowable lateral drift of each story to 2.5%. Moreover, the maximum expected lateral drift ratio of a story in CSA/S806-12 (CSA 2012) for FRP-RC building structures is 4%.

Test Results

Overall Behaviour and Hysteresis Diagram

FIG. 9 shows pictures of Specimen G-N after the first loading phase and also shows its lateral load-drift response (hysteresis diagram). The dashed lines in the hysteresis diagram show the design capacity of the specimen. As shown in FIG. 9(*b*), Specimen G-N (reinforced with GFRP without steel plates) showed linear behaviour till 4% drift ratio with insignificant residual displacement. This agrees with picture of the specimen in FIG. 9(*a*) that shows no concrete spalling or crushing. Moreover, there was no sign of damage penetration into the joint area. This low magnitude of concrete damage is also indicated by narrow loops in the specimen's hysteresis diagram, which also confirms low energy dissipation of the GFRP-RC beam. These observations indicate that GFRP-RC structures can undergo large lateral deformations while maintaining their linear nature and original condition to an acceptable degree.

Following the first loading phase, the specimen was loaded under the second loading series from 0% drift ratio until failure. Picture of the specimen at failure and its hysteresis diagram in the second loading phase are shown in FIG. 10. The failure occurred at 6% drift ratio due to rupture of the longitudinal reinforcement. It should be mentioned again that 6% drift ratio is considered beyond the response range of a regular structure, since significant secondary moments can be generated in the structural elements due to P-Δ effect.

FIG. 11 shows hysteresis diagram of Specimen S-N and its pictures after 4% drift ratio and failure. According to the specimen's hysteresis diagram, the longitudinal reinforcement yielded at 1.5% drift ratio which resulted in ductile behaviour of the specimen indicated by wide hysteresis loops. However, at the same time this yielding increased the residual displacement (pinching) at zero load condition, therefore severe concrete damage was observed in the beam at the vicinity of support while reaching 4% drift ratio.

Due to yielding of steel reinforcement, it was not possible to restore the original condition of Specimen S-N after the first loading phase, thus the logic behind the two-phase loading procedure that was used for the GFRP-RC specimens was note applicable to the steel-RC specimen. Therefore, after 4% drift ratio the loading procedure was continued according to FIG. 8 until failure of Specimen S-N. The specimen failed at 6% drift ratio by exhibiting significant decrease in lateral load carrying capacity (30% decrease from the maximum lateral load).

FIG. 12 shows lateral load-drift respond of Specimen G-M in the first loading phase and its condition at 4% drift ratio. Specimen G-M combined linearity of GFRP-RC structures with ductility of steel-RC structures. Yielding of the steel plates was observed at 1.5% drift ratio where the specimen started to exhibit non-linear lateral load-drift response and wider hysteresis loops. Although the steel plates were severely deformed and damaged (FIG. 12(*c*)), the concrete beam maintained its integrity and original condition (to an acceptable degree) after 4% drift ratio. FIG. 13 shows picture of the beam after removing the steel plates. It was observed that steel plates also improved the performance of the specimen by reducing the number of cracks in the concrete beam compared to Specimen G-N (GFRP-RC without steel plates).

FIG. 14 compares envelops of lateral load-drift response of the specimens in the first loading phase. As expected the steel plates improved the seismic performance of the GFRP-RC beam by increasing its initial stiffness up to approximately the initial stiffness of Specimen S-N. However, unlike specimen S-N, Specimen G-M did not reach any plateau and continued on carrying increasing lateral load after 1.5% drift ratio.

The damaged steel plates in Specimen G-M were replaced with new plates and the specimen was re-tested under the second series of cyclic loading (from 0% till failure). FIG. 15 shows a picture of the specimen at failure and its hysteresis diagram in the second loading phase. The failure occurred due to rupture of the longitudinal bars at 7% drift ratio.

FIG. 16 compares lateral load-drift envelop of the specimens in the second loading phase. As the graph shows, although replacing the damaged steel plates with the new ones increased the initial stiffness of Specimen G-M compared to Specimen G-N in the second loading phase, the initial stiffness was not as high as Specimen S-N. It is believed that one of the reasons for lower initial stiffness of Specimen G-M in the second loading phase may be due to the gap between the bolts and the replacement steel plates (in the second loading phase) which delayed loading of the steel plates (FIG. 17). During construction of Specimen G-M, the first set of steel plates were left inside the formwork while the beam was cast with concrete. Therefore, all gaps between the bolts and the plates were filled with concrete, thus the plates performed satisfactory as no shifting of the plates relative to the concrete was allowed during initial loading. As outlined above, the issue of the gap between the bolts and the new replacement steel plates can be resolved by injecting grout into the gaps and sealing the grout-filled gap with washers and nuts when installing the replacement plates.

Energy Dissipation

FIG. 18 compares the cumulative amount of energy dissipated by the specimens at the first cycle of each drift ratio in the first loading phase. The dissipated energy is calculated as the area enclosed by the hysteresis loops in lateral load-displacement response of the specimens.

As expected, steel plates increased the amount of energy dissipated by the GFRP-RC beam. The improvement was 160% at 2.5% drift ratio and 145% at 4% drift ratio compared to Specimen G-N. It should be mentioned that the dissipated energy by Specimen S-N was 475% and 500% higher compared to Specimen G-N at 2.5% and 4% drift ratio, respectively.

Dynamic Analysis

In order to better illustrate the effect of steel plates on the overall seismic performance of structures with a moment-resisting frame system, a computer model was created to simulate non-linear dynamic response of an arbitrary 10-story moment-resisting frame under the ground acceleration history recorded for the 1999 Chi-Chi, Taiwan earthquake with peak ground acceleration (PGA) of approximately 0.5 g (FIG. 19). The finite element program SAP2000 (CSI 2016) was used to perform the non-linear dynamic analysis.

FIG. 20 shows the geometry and analytical model of the arbitrary frames under investigation. Three frames were considered, each corresponding to one of the tested specimens (G-N or S-N or G-M). For simplicity, the beams were modeled with relatively high stiffness to limit degrees of freedom to only horizontal displacement in each story. Each column was modeled as a set of spring and damper with properties obtained from each test specimen.

It should be mentioned that by using properties of the test specimens for the columns in the dynamic model, the model does not represent an actual moment-resisting frame since the columns in test specimens were relatively stiff and the boundary condition (fixed columns) simulated a cantilever beams and not a beam-column assembly, which could better represent lateral stiffness of each story. However, for the purpose of comparison, the constructed model is valid since all specimens were tested under the same condition. Therefore, it is emphasised that the purpose of this dynamic analysis was only to evaluate the effectiveness of the steel plates in improving the seismic performance of GFRP-RC frames.

The beam-column joints (springs) in each frame were modeled based on nonlinear lateral load-displacement response of the test specimens. The exterior beam-column joints in the modeled frames were assumed to have the same lateral load-drift ratio response as the test specimens. By assuming a height of 3000 mm for the columns (FIG. 20(*a*)), lateral load displacement response of each exterior beam-column joint was calculated. For example, Specimen S-N exhibited 97-kN beam tip load at 2% drift ratio (positive direction), therefore, each exterior beam-column joint (spring) in the corresponding modeled frame exhibits 97-kN load at 2% drift ratio, which is corresponding to 0.02×3000=60-mm lateral displacement of each story relative to its immediate lower story. The lateral stiffness of interior beam-column joints were also calculated using the same procedure, except that the load resisting capacity of the interior beam-column joint were assumed to be twice the capacity of their corresponding test specimens, since two beams (one on each side of the column) will provide resistance against lateral movement. FIG. 21 shows lateral load-displacement relationship of the interior beam-column joints used for the dynamic analysis. The beam-column joints were assumed to have identical response in both positive and negative direction.

For simplicity, constant damping ratio was used for the analysis. Same as the stiffness, the damping ratio for the beam-column joints in each frame was obtained from the test specimens. The damping ratio for each specimen was calculated using the area enclosed by the hysteresis diagrams at 1.5% drift ratio. Therefore, the equivalent Viscus ratio for Specimens G-N, S-N and G-M was calculated as 0.03, 0.06 and 0.036, respectively. By assuming 6,000 kg mass for each interior beam-column joint (3,000 kg for exterior and roof joints), damping coefficient for the beam-column joints corresponding to each specimen was calculated. Table 3 shows the calculated damping coefficients.

TABLE 3

Damping coefficients used in the FEM model

| | Damping Coefficient (kN · S/mm) | | |
|---|---|---|---|
| Joint Type | S-N | G-N | G-M |
| Interior | 0.0592 | 0.0213 | 0.0338 |
| Exterior | 0.0296 | 0.0107 | 0.0169 |
| Roof | 0.0419 | 0.0151 | 0.0239 |

The analysis was performed by direct integration. The results of the non-linear dynamic analysis are provided in FIG. 22 and Table 4. FIG. 22 shows lateral displacement of the first floor in each of the modeled frames and Table 4 compares the maximum inter-story drift ratio (the drift ratio relative to the immediate lower story) of the frames corresponding to Specimens S-N and G-M. As shown in FIG. 22, the frame corresponding to Specimen G-N (GFRP-RC without steel plates) failed due to excessive deformation at the first story (more than 6% drift ratio). As explained earlier, this was expected due to low initial stiffness and energy dissipation of the frame.

The frame corresponding to Specimen S N (steel RC) was able to survive the earthquake. However, the maximum lateral displacement of the first story (109 mm) exceeded the linear range of the structure as shown in FIG. 21. Therefore, although the frame was able to survive the earthquake, it will not maintain the service condition due to yielding of the reinforcement.

The frame corresponding to Specimen G-M (GFRP-RC with steel plates) also was able to survive the ground shaking. As shown in Table 4, the maximum lateral drift ratio recorded for the frame was 3.47%. This drift ratio is less than 4%, the maximum drift ratio of the first loading phase in the experimental program. As indicated by the test results, Specimen G-M was able to reach 4% drift ratio with insignificant concrete damage; therefore, by replacing damaged steel plates with new ones and with following proper procedure to ensure effective composite behaviour of the concrete beam and the new steel plates the frame will be able to restore its service condition.

TABLE 4

| Maximum inter-story lateral drift ratio of the frames corresponding to S-N & G-M | | | | | | | | | | |
|---|---|---|---|---|---|---|---|---|---|---|
| | 1st Floor | 2nd Floor | 3rd Floor | 4th Floor | 5th Floor | 6th Floor | 7th Floor | 8th Floor | 9th Floor | 10th Floor |
| S-N | 3.62% | 3.21% | 2.43% | 1.83% | 1.47% | 1.07% | 0.73% | 0.57% | 0.40% | 0.17% |
| G-M | 3.47% | 3.20% | 2.70% | 2.23% | 1.8% | 1.30% | 0.93% | 0.57% | 0.37% | 0.13% |

As Table 4 shows, the frames corresponding to Specimens S-N and G-M, showed very similar behaviour in terms of maximum drift ratio of each story. In both cases the maximum drift ratio decreases in higher stories. Therefore, since GFRP-RC frames can undergo large deformations without significant permanent damage, it may not be necessary to use steel plates in beam-column joints of the higher stories. Eliminating the steel plates from higher stories allows larger lateral displacement in them (to an acceptable level according to a GFRP-RC capacities) while eliminating the extra process and expense of installing steel plates at higher levels.

To investigate the effectiveness of using steel plates only in lower stories on the seismic performance of GFRP-RC frames, the previous model of the frame corresponding to Specimen G-N was replicated, but differed by using steel plates on the beam-column joints of only the first two or six stories. FIG. 23 compares the last story lateral displacement response of these frames with the frame corresponding to Specimen G-M (with steel plates on beam-column joints of all stories).

According to the figure, all frames were able to survive the ground acceleration; therefore, adding steel plates to beam-column joints of the first two stories of the GFRP-RC frame prevented the failure due to the earthquake. However, the last story still undergoes significantly larger deformations compared to the frame with steel plates on all beam-column joints. This can result in excessive secondary moments in lower stories due to P-Δ effect. The lateral displacement response of the last story in the frame with steel plate on the first six stories; however, is closer to the frame with steel plates on all beam-column joints.

Table 5, compares the maximum drift ratio of each story in the frames with steel plates in the first three and four stories. As expected, removing steel plates from beam-column joints of the higher stories increased their maximum drift ratio. However, the maximum drift ratios in the frame with steel plates on the first six stories remains in the elastic range of the frame (under 4% drift ratio).

Test Conclusions

According to the results obtained from the test specimens and the analytical study, the following conclusions were made:

- The proposed combination of steel plates and concrete beams improved the seismic performance of the tested GFRP-RC beam by increasing its initial lateral stiffness and cumulative energy dissipation. The steel plates increased the energy dissipation of the GFRP-RC beam by 160% at 2.5% drift ratio (the maximum allowable drift ratio by NRCC 2015). Moreover, the plates increased the initial stiffness of the GFRP-RC beam to be similar to that of the steel-RC counterpart with the same moment capacity. Also, at 4% drift ratio, the magnitude of concrete damage in the GFRP-RC beam with steel plates was lower than its counterpart without steel plates.
- Replacing damaged steel plates with new ones could restore the initial properties of the beam; however, special care must be taken in filling the gaps between the bolts embedded in the concrete and the plates.
- The results of the non-linear dynamic analysis indicated that the proposed steel plates significantly improve the dynamic response of GFRP-RC frames. Increasing the initial stiffness and energy dissipation of GFRP-RC beams due to implementation of the steel plates significantly reduced lateral deformation of the modeled GFRP-RC frame and prevented the failure while the GFRP-RC frame without the damper failed due to excessive inter-story deformations.
- The non-linear dynamic analysis showed that by eliminating the steel plates from beam-column joints of higher stories, the GFRP-RC frame still was able to survive the earthquake loading, while all beam-column joints were in the linear range. Therefore, the construction cost and time can be reduced by installing the steel plates on only selective number of beam-column joints in a frame building.

TABLE 5

| Max. inter-story lateral drift ratio of the frames with steel plates in lower stories | | | | | | | | | | |
|---|---|---|---|---|---|---|---|---|---|---|
| | 1st Floor | 2nd Floor | 3rd Floor | 4th Floor | 5th Floor | 6th Floor | 7th Floor | 8th Floor | 9th Floor | 10th Floor |
| Steel Plates in first two floors | 2.63% | 2.33% | 4.20% | 3.47% | 2.83% | 2.33% | 1.77% | 0.97% | 0.53% | 0.23% |
| Steel Plates in the first six floors | 3.43% | 2.97% | 2.53% | 2.43% | 2.03% | 1.60% | 2.70% | 2.00% | 0.90% | 0.37% |

It worth mentioning that in analyzing a real moment-resisting frame, it is necessary to also include potential P-Δ effects due to relatively larger deformations of the higher stories caused by eliminating steel plates.

The experimental tests to demonstrate the principles of the present invention used simple two-dimensional, single-beam T-joints, but it will be appreciated that in practical application, the principles of the present invention will be applied to buildings with more complex multi-beam joints, bridges or any other structural systems. In the case where multiple beams connect to the column from different sides thereof, as schematically illustrated in FIG. 24, where first and second horizontal beams 10, 12 lie at ninety degrees to one another and join up with perpendicularly neighbouring sides of the column 14, connection of a plate to both the side of the first beam and the side of the column that is flush with said side of the beam would not be possible if the second beam is a full size beam spanning the full width of that side of the column. FIG. 24(*a*) thus shows a solution in which the first beam 10 is a full size beam spanning a full width of the column at the first side 14*a* thereof from which the first beam projects, so that the two sides of the first beam 10 are flush with second and third sides of the column from the opposing second and third beams extend. The second and third beams 12, 16 are instead made of lesser width than the second and third sides 14*b*, 14*c* of the column 14 from which they respectively project. Using the term proximal end to refer to the end of the first beam that is integrally attached to the column, as denoted in broken lines at 10*p* in FIG. 24(*a*), this leaves an open area 20 on the second side 14*b* of the column 14 between the second beam 12 and the proximal end 10*p* of the first beam, and likewise leaves an matching open area on the third side 14*c* of the column 14 between the third beam 16 and the proximal end 10*p* of the first beam 10.

As shown in FIGS. 24(*c*) and (*d*), each side of the first beam is equipped with a bent plate 22 having first and second legs 22*a*, 22*b* that diverge from one another at ninety degrees. The first leg 22*a* overlies the side of the first beam 10 and spans beyond the proximal end 10*p* of the first beam 10 and onto the available open area 20 on the respective second or third side 14*b*, 14*c* of the column 14 by the smaller second or third beam 12, 16. The second leg 22*b* of each bent plate 22 then diverges from the first leg 22*a* at a right angle to overlie and extend along the face 12*a*, 16*a* of the second or third beam. As used herein, the face of the second or third beam refers to the side thereof that faces the same direction in which the first beam projects from the column 14.

The first leg 22*a* of each bent plate 22 is fastened to the first beam 10 by a respective set of embedded support members projecting to a respective side of the first beam, while the second leg of each bent plate is fastened to the respective one of the second or third beams 12, 16 by another embedded set of support members whose threaded shafts project from the face 12*a*, 16*a* of the second or third beam. This way, the first leg 22*a* of each bent plate spans across the first beam's juncture with the column 14. It is also important to take proper measures to ensure that the second and third beams 12, 16 provide sufficient stiffness to properly anchor each bent plate 22. In the illustrated example, the second and third beams 12, 16 are not only narrower than the first beam, but also shorter in height than the first beam, and the topside of all three beams 10, 12 16 are flush or coplanar with one another, whereby the undersides of the shorter second and third beams 12, 16 are elevated relative to the underside of the first beam 10. The first leg 22*a* of each bent plate 22 includes a lower extension tab 24, which can be seen in FIG. 24(*d*). This extension tab 24 further across the column 14 than the rest of the bent plate's first leg 22*a*, and reaches beyond the plane of the second or third beam's face to reach under the second leg 22*b* of the bent plate and onward under the elevated underside of the second or third beam 12 16. In the illustrated example, one of the fastener holes of the bent plate 22 is provided in this extension tab 24 in order to accommodate a respective support element whose threaded shaft projects form the respective side of the column to further attach the metal plate 22 not only to the beams, but also directly to the column 14 as well.

It will be appreciated that other configurations of the steel plate and particular geometric relationships between the multiple beams and the column of a three dimensional, multi-beam joint may alternatively be employed to enable similar placement of the steel plate at the joint so as to span across the juncture of the column with one or more of the beams. FIG. 25 illustrates one example, where four bent plates are used between all four beams of an interior frame joint, as opposed to the FIG. 24 example of two bent plates used between the three beams of an exterior frame joint. The FIG. 25 example illustrates how all beams may be of the same dimension, with each bent plate being attached solely to two adjacent beams that project from neighbouring perpendicular sides of the shared column. Each bent plate in this example lacks specific attachment directly to the beam, and thus lacks an extension tab that reach under a smaller one of two differently sized adjacent beams.

Since various modifications can be made in my invention as herein above described, and many apparently widely different embodiments of same made, it is intended that all matter contained in the accompanying specification shall be interpreted as illustrative only and not in a limiting sense.

REFERENCES

ACI Committee 374. (2005). "Acceptance Criteria for Moment Frames Based on Structural Testing and Commentary." ACI 374.1-05, American Concrete Institute, Farmington Hills, Mich., 88 p.

ACI Committee 440. (2015). "Guide for Design and Construction of Concrete Reinforced with FRP Bars." ACI 440.1R-15, American Concrete Institute, Farmington Hills, Mich., 44 p.

CSA (2014). "Concrete Materials and Methods of Concrete Construction/Test Methods and Standard Practices for Concrete." CAN/CSA A23.1/A23.2-14, Canadian Standard Association, Ontario, Canada, 690 p.

CSA. (2012). "Design and Construction of Building Structures with Fibre Reinforced Polymers." CAN/CSA-S806-12, Canadian Standards Association, Ontario, Canada, 206 p.

CSI. (2016). "CSI Analysis Reference Manual for SAP2000, ETABS, SAFE and CSiBridge." Computers and Structures Inc., California, USA, 206 p.

Duggal, S. (2014). "Earthquake Resistant Design of Structures ($2^{nd}$ Edition)". Oxford University Press, 528 p.

Fukuyama, H., Masuda, Y., Sonobe, Y. and Tanigaki, M. (1995). "Structural Performances of Concrete Frame Reinforced with FRP Reinforcement," Non-Metallic (FRP) Reinforcement for Concrete Structures, Ghent, Belgium, pp. 275-286.

Ghomi, S. and El-Salakawy, E. (2016). "Seismic Performance of GFRP-RC Exterior Beam-Column Joints with Lateral Beams." Journal of Composites for Construction, ASCE, 20 (1), 11 p., 10.1061/(ASCE)CC.1943-5614.0000582.

Hasaballa, M. H. and El-Salakawy, E. (2016). "Shear Capacity of Type-2 Exterior Beam-Column Joints Reinforced with GFRP Bars and Stirrups." Journal of Composites for Construction, ASCE, 20 (2), 13 p., 10.1061/(ASCE) CC.1943-5614.0000609.

Mady, M., El-Ragaby, A. and El-Salakawy, E. (2011). "Seismic Behavior of Beam-Column Joints Reinforced with GFRP Bars and Stirrups." Journal of Composites for Construction, ASCE, 15 (6): 875-886.

NRCC. (2015). "National Building Code of Canada (NBCC)." National Research Council of Canada, Ottawa, Ontario, 1245 p.

Said, A. M. and Nehdi, M. L. (2004). "Use of FRP for RC Frames in Seismic Zones: Part II. Performance of Steel-Free GFRP-Reinforced Beam-Column Joints." Applied Composite Materials, V. 11, pp. 227-245.

Schoeck Canada Inc. (2014), "Schöck-ComBAR™, Technical Information sheet", Available on http://www.schoeck.ca.

The invention claimed is:

1. A beam-column joint at an integral juncture between a concrete column and a concrete beam that are integrally and directly attached to one another by concrete of said concrete column and said concrete beam, said beam-column joint comprising internal reinforcements of fiber reinforced polymer embedded within integrally and directly interconnected concrete cores of said concrete column and said concrete beam, and said beam-column joint further comprising at least one external member attached to said concrete beam and spanning across said integral juncture in external relation to said concrete column and said concrete beam.

2. The beam-column joint of claim 1 wherein said at least one external member comprises a pair of external members attached to opposing sides of said concrete beam.

3. The beam-column joint of claim 2 comprising support elements that are partially embedded within the concrete of said concrete beam and project externally thereof to support the at least one external member thereon, said support elements comprising two sets of support elements, of which each set projects from only a singular respective one of two opposing sides of said concrete beam to support a respective one of the pair of external members thereon.

4. The beam-column joint of claim 3 wherein each of said support elements comprises a threaded shaft that projects externally of the concrete beam, and has an enlargement on an internal end of the shaft that resides in an embedded position within the concrete.

5. The beam-column joint of claim 1 comprising support elements that are partially embedded within the concrete of said concrete beam and project externally thereof to support the at least one external member thereon.

6. The beam-column joint of claim 5 wherein each of said support elements comprises a threaded shaft that projects externally of the concrete beam, and has an enlargement on an internal end of the shaft that resides in an embedded position within the concrete.

7. The beam-column joint of claim 1 wherein said external member is also attached to said column.

8. The beam-column joint of claim 1 wherein said at least one external member comprises a bent external member attached to first and second concrete beams that extend from neighbouring first and second sides of said concrete column.

9. The beam-column joint of claim 8 wherein the second concrete beam spans less than a full width of the column at the second side thereof, and leaves an open area at the second side of the column between the second concrete beam and a proximal end of the first concrete beam at which said first concrete beam joins with the concrete column, and a first leg of the bent external member extends past said proximal end of the first concrete beam and over said open area to a face of the second concrete beam, where a second leg of the bent external member then diverges from the first leg and spans along the second concrete beam.

10. The beam-column joint of claim 9 wherein an extension of the first leg of the bent external member reaches beyond the face of the second concrete beam.

11. The beam-column joint of claim 10 wherein the bent external member is fastened to the column at said extension of the first leg.

12. The beam-column joint of claim 1 wherein the at least one external member comprises a metal member.

13. The beam-column joint of claim 1 wherein the at least one external member comprises a steel member.

14. The beam-column joint of claim 1 wherein the at least one external member is bolted in place.

15. The beam-column joint of claim 14 comprising bolts partially embedded in the concrete core of the concrete beam with threaded shafts of said bolts projecting externally from said concrete core of the concrete beam, heads of said bolts residing internally of said concrete core in embedded positions within the concrete, and corresponding nuts engaged with said threaded shafts to hold said at least one external member on the concrete beam.

16. A concrete multi-story moment resisting frame comprising intersecting columns and beams, said multi-story moment resisting frame comprising beam-column joints of the type recited in claim 1 at one or more lower stories of said multi-story moment resisting frame, and also comprising one or more upper stories lacking the external members of said beam-column joints found in the one or more lower stories.

17. A method of repairing a seismically damaged concrete moment resisting frame that comprises intersecting columns and beams, at least some of which are joined together by beam-column joints of the type recited in claim 1, said method comprising substituting a replacement external member for a damaged external member at one or more said beam-column joints.

18. The method of claim 17 comprising, during substitution of the replacement external member for the damaged external member, filling in gap spaces situated within fastener holes of said replacement external member.

19. The method of claim 18 comprising filling said gap spaces with grout.

20. A method of improving seismic resistance of a beam-column joint at which a concrete column and a concrete beam meet one another and are integrally and directly attached to one another by concrete of said concrete column and said concrete beam, and within which fibre reinforced polymer reinforcements are embedded within integrally and directly interconnected concrete cores of said concrete column and said concrete beam, the method comprising externally attaching at least one external member to the concrete beam in a position spanning across a juncture between said concrete beam and said concrete column.

21. The method of claim 20 comprising partially embedding support elements within a concrete core of said concrete beam during casting thereof to provide support for the at least one external member on portions of said support elements that project externally from the resulting concrete core.

22. The method of claim 21 comprising supporting the at least one external member on the support elements within a formwork in which the concrete core of said concrete beam is subsequently cast such that gaps between said at least one external member and said support elements are filled by flowable concrete during casting of said concrete core.

23. The method of claim 21 wherein said externally projecting portions of the support elements comprise threaded shafts, and the method comprises engaging nuts onto said threaded shafts to hold the at least one external member on said concrete beam.

24. The method of claim 21 wherein said at least one external member comprises a pair of external members, and the method comprises embedding two sets of support elements in the concrete core in positions respectively projecting from opposing sides of said concrete beam, and attaching said pair of external members to said concrete beams at said opposing sides thereof.

25. The method of claim 20 wherein said at least one external member comprises a pair of external members, and the method comprises attaching said pair of external members to opposing sides of said concrete beam.

26. The method of claim 20 wherein said at least one external member comprises a bent external member, and the method comprises attaching said bent external member to both first and second concrete beams that project from neighbouring first and second sides of the column.

27. The method of claim 26 comprising additionally attaching said external member to the column at the second side thereof at an open area of said second side that is unoccupied by the second concrete beam.

28. The method of claim 27 wherein the open area is disposed between a face of the second concrete beam and a proximal end of the first concrete beam at which said first concrete beam joins with the column.

29. The method of claim 27 comprising attaching a first leg of the bent external member to the first concrete beam, attaching a second diverging leg of the bent external member to a face of the second concrete beam, and further attaching the first leg to the column at an extension of said first leg that reaches beyond the face of the second concrete beam.

30. The method of claim 20 wherein the at least one external member comprises a metal member.

31. The method of claim 20 wherein the at least one external member comprises a steel member.

* * * * *